US005260691A

United States Patent [19]

Shyu

[11] Patent Number: 5,260,691

[45] Date of Patent: Nov. 9, 1993

[54] FIRE ALARM DEVICE ACCOMPANIED WITH AIR CONDITIONER

[75] Inventor: Jia-Ming Shyu, Taipei, Taiwan

[73] Assignee: Norm Pacific Automation Corp., Taiwan, Taiwan

[21] Appl. No.: 605,418

[22] Filed: Oct. 30, 1990

[51] Int. Cl.[5] ..... G08B 17/00

[52] U.S. Cl. ..... 340/589; 340/693; 340/628; 454/257; 454/258

[58] Field of Search ..... 340/589, 693, 627, 628; 454/229, 257, 342, 357, 258

[56] References Cited

U.S. PATENT DOCUMENTS 4,088,986 5/1978 Boucher ..... 340/628
4,853,693 8/1989 Eaton-Williams ..... 340/589
4,884,222 11/1989 Nagashima et al. ..... 340/589
4,996,517 2/1991 Kringen et al. ..... 340/539

FOREIGN PATENT DOCUMENTS 0270990 8/1989 Fed. Rep. of Germany ..... 340/589
59-97441 6/1974 Japan ..... 454/257

*Primary Examiner*—Donnie L. Crosland
*Attorney, Agent, or Firm*—Spencer, Frank & Schneider

[57] ABSTRACT

A combination fire alarm/air conditioner, which can immediately detect a fire. The device includes a temperature-sensor and/or a smoke-sensor installed in the room-side air inlet of the air conditioner. Signals generated by the sensor are received by a microcomputer which monitors them based on a threshold and a rate of change of the signals. When the rate of change of the signals exceeds the threshold, the microcomputer produces signals which set off an alarm.

5 Claims, 2 Drawing Sheets

FIRE ALARM DEVICE ACCOMPANIED WITH AIR CONDITIONER

BACKGROUND OF THE INVENTION

This invention relates to a fire alarm device having a temperature sensor and/or a smoke sensor installed in the roomside air inlet of an air conditioner, which can promptly and accurately sense the danger of a fire disaster when it is just beginning.

The conventional fire alarm system, of which the electric wires are laid indoors and the fire alarm sensor (temperature sensor and/or smoke sensor) is installed in the ceiling of the building, usually can not sense fire disaster promptly because the sensor is far from the source of fire, or the electric wires have been burn down or melted by the fire. The kitchen in a home or a restaurant, generally speaking, is a place in which a fire is apt to start; however, smoke from cooking may make the smoke alarm system misidentify it as a signal of a fire disaster. Also, the temperature sensor may be delayed in identifying a fire disaster because of the indoor temperature may be adjusted by an air conditioner. Thereby, the effect of fire prevention is not obvious by using the above mentioned facilities. Furthermore, the conventional fire alarm system gives an alarm based on a sensed value when it reaches a preset threshold which is usually a little bit higher than the actual critical value in order to prevent misjudgement, which relatively reduces the desired effect of fire prevention.

SUMMARY OF THE INVENTION

This invention, in order to solve the problems mentioned above, provides a device which can promptly and accurately sense the danger of a fire disaster when it is just beginning.

This invention is to install a sensor in the room-side air inlet of an air conditioner whose output is used by a microcomputer to detect the occurrence of a fire disaster based on a preset threshold and the rate of variation of smoke or temperature of the indoor air sucked in by the air conditioner and gives a fire alarm when the sensed values reach the threshold.

BRIEF DESCRIPTION OF THE DRAWING

The composition and function of this invention will he expressed with reference to the appended FIGS. 1 and 2 which show an embodiment of this invention.

DETAILED DESCRIPTION OF PREFERRED EMBODIMENTS

Figure 1:
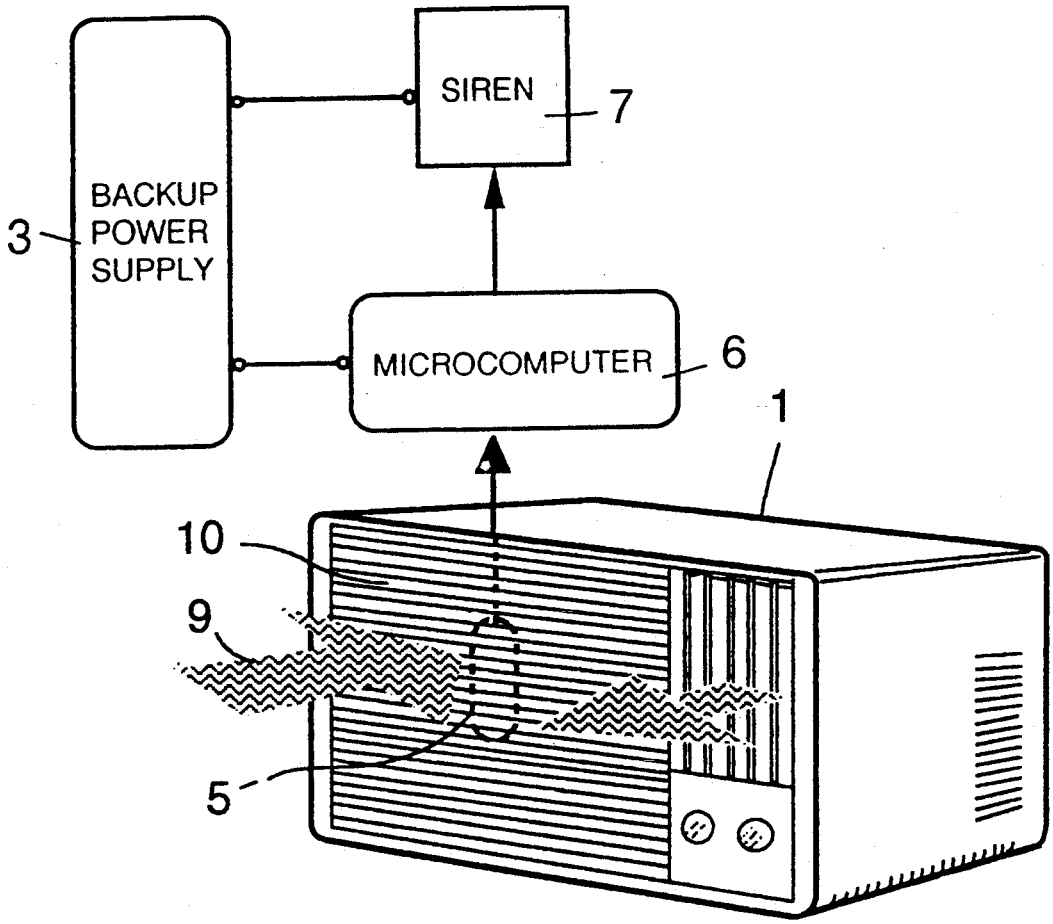
Figure 2:
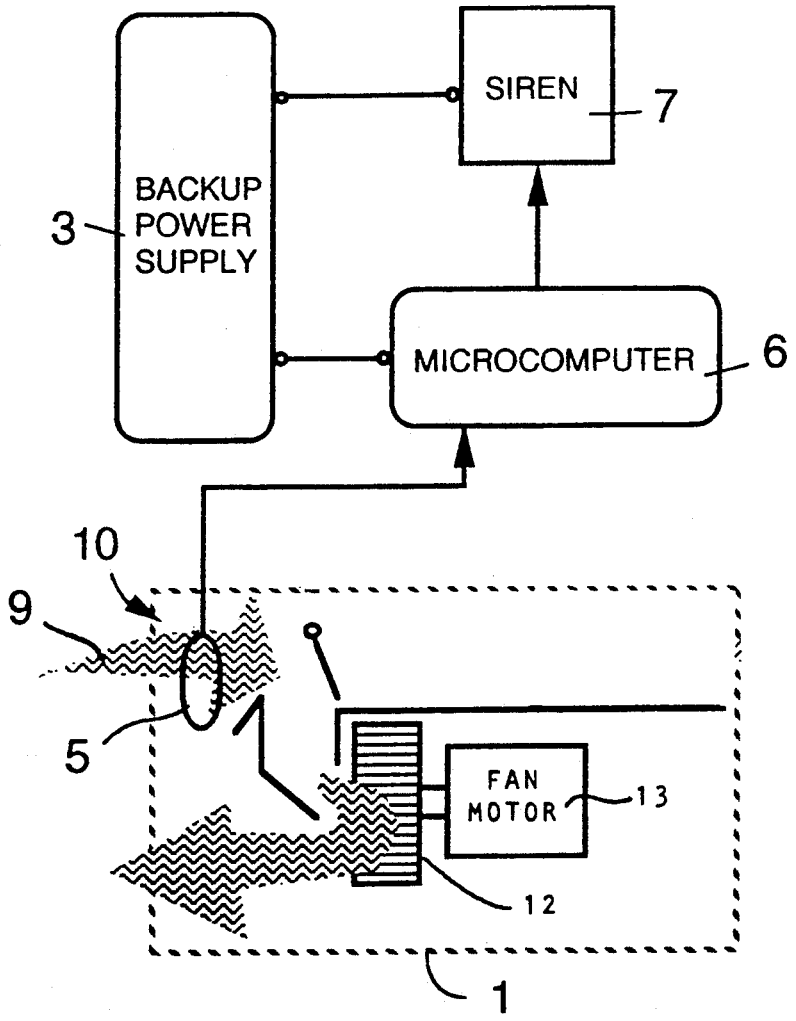

As the figures show, this invention comprises a sensor 5 installed in the room-side air inlet 10 of an air conditioner 1, which senses the temperature or smoke condition of the indoor air 9 sucked in by the fan 12 powdered by a fan motor 13 of the air conditioner 1. A microcomputer 6 calculates the variation of the sensed value at intervals of a certain time duration; and when the sensed value and its variation show a tendency toward a possible fire disaster, the signal of fire alarm will be sent to a siren 7 to notify the fire department or persons having a relation to the property, or automatically turn on an indoor fire-extinguisher at the same time. A backup power supply 3 can be installed, to supply the needed power of the microcomputer 6 and the siren 7 in case of a power failure. It can be attained by the prior art of uninterrupted power supply which will not be further described herein.

This invention, not only creates a f ire alarm system installed in an air conditioner, but also provides the following advantages:

1. The indoor layout of electric wires is not needed for this invention which can reduce the chance of disconnected wires and power failure; also sensor is installed in the interior of the air conditioner so as not to be visible.

2. It can promptly and accurately detect the occurrence of fire disaster and reduce the chance of misjudgement or delayed judgement.

This invention can not only be applied to a window-size air conditioner but also a central air conditioning system or other machines that provide the function of air circulation. These modifications are included in the extent of the appended claims.

I claim:

1. A combination fire alarm/air circulating system for a room, comprising:

means for circulating air in the room, said circulating means having an air inlet and means for drawing the room air into said air inlet;

sensing means, located in said air inlet for sensing at least one of temperature and smoke values of the room air drawn into said air inlet by said drawing means; and a microcomputer for monitoring the values sensed by said sensing means, calculating a rate of change of said values, comparing the calculated rate of change to a preset threshold and generating a warning signal if the calculated rate of change exceeds the preset threshold.

2. A system of according to claim 1, further comprising a backup power supply to supply power for said system during a period of power failure.

3. A system according to claim 1, where said means for circulating air is a window air conditioner.

4. A system according to claim 1, wherein the means for circulating air is a central air conditioning system.

5. A system according to claim 1, further comprising an alarm means, responsive to said warning signal, for providing a warning of a fire.

* * * * *